US005095717A

United States Patent [19]

Germi

[11] Patent Number: 5,095,717

[45] Date of Patent: Mar. 17, 1992

[54] REFRIGERATING APPARATUS WITH AN EVACUATABLE CONTAINER

[75] Inventor: Franco Germi, Gavirate, Italy

[73] Assignee: Whirlpool International B.V., Tarwelaan, Netherlands

[21] Appl. No.: 545,306

[22] Filed: Jun. 26, 1990

[30] Foreign Application Priority Data

Jun. 30, 1989 [IT] Italy ..... 21054 A/89

[51] Int. Cl.[5] ..... F25D 25/02

[52] U.S. Cl. ..... 62/382; 62/441; 62/268; 417/313

[58] Field of Search ..... 62/441, 268, 100, 382; 417/313

[56] References Cited

U.S. PATENT DOCUMENTS 4,751,826 6/1988 Kawahara et al. ..... 62/441

FOREIGN PATENT DOCUMENTS 1377844 12/1963 France ..... 62/382

2559355 4/1985 France .

*Primary Examiner*—Albert J. Makay
*Assistant Examiner*—John Sollecito
*Attorney, Agent, or Firm*—Ernestine C. Bartlett

[57] ABSTRACT

A refrigerating apparatus is provided which comprises a cabinet (1) with a refrigeration compartment (10) closable by a door (12), which compartment is connected to an evacuating system comprising a vacuum pump (6) arranged in the cabinet and an evacuation pipe (8) between the vacuum pump and said compartment. The apparatus comprises a container (17) closable in a vacuum-tight manner and movable within said compartment (10), and means for detachably connecting the inner space of the container (17) with the pipe (8) of the evacuating system. The means comprise a container pipe (23) provided in a wall (24) of the container (17) through which the inner space of the container can be evacuated, and a hollow elastic element (25) connected to one of the ends of the pipes (8,23) facing each other to form a detachable seal against the other end.

19 Claims, 2 Drawing Sheets

REFRIGERATING APPARATUS WITH AN EVACUATABLE CONTAINER

FIELD OF THE INVENTION

The invention relates to a refrigerating apparatus comprising a cabinet with a refrigeration compartment closable by a door, which compartment is connected to an evacuation system comprising a vacuum pump arranged in the cabinet and an evacuation pipe between the vacuum pump and said compartment.

BACKGROUND OF THE INVENTION

It is well known that cold preservation of foods under vacuum has considerable advantages. It enables such foods to be kept in a refrigerator for a long period without degrading.

A refrigerating apparatus of the above mentioned type is described in FR-A-2 559 355. A disadvantage of such a construction for evacuating a compartment is the necessity of several valve members including a valve member disposed at the door used to close said compartment in an air-tight manner. Such valve members enable vacuum to be maintained within said compartment when desired, and to release the vacuum when access is required to the compartment to take foods out.

SUMMARY OF THE INVENTION

An object of the invention is to provide a refrigerating apparatus with evacuation means which is of a simple and reliable construction, low cost and easy to operate. According to the invention the refrigerating apparatus is characterized by comprising a container closable in a vacuum-tight manner and movable within said compartment, and means for detachably connecting the inner space of the container with the evacuation pipe of the evacuation system.

A preferred embodiment is characterized in that the means comprises a container pipe provided in a wall of the container through which the inner space of the container can be evacuated, and a hollow elastic element connected to one of the ends of the pipes facing each other to form a detachable seal against the other end. By moving the container inside the compartment a sealed connection between the pipes can be easily obtained. Preferably the hollow elastic element is a sucker or a bellows.

BRIEF DESCRIPTION OF THE DRAWINGS

These and further embodiments will be described hereafter with reference to the accompanying drawing in which.

DETAILED DESCRIPTION OF THE PREFERRED EMBODIMENTS

Figure 1:
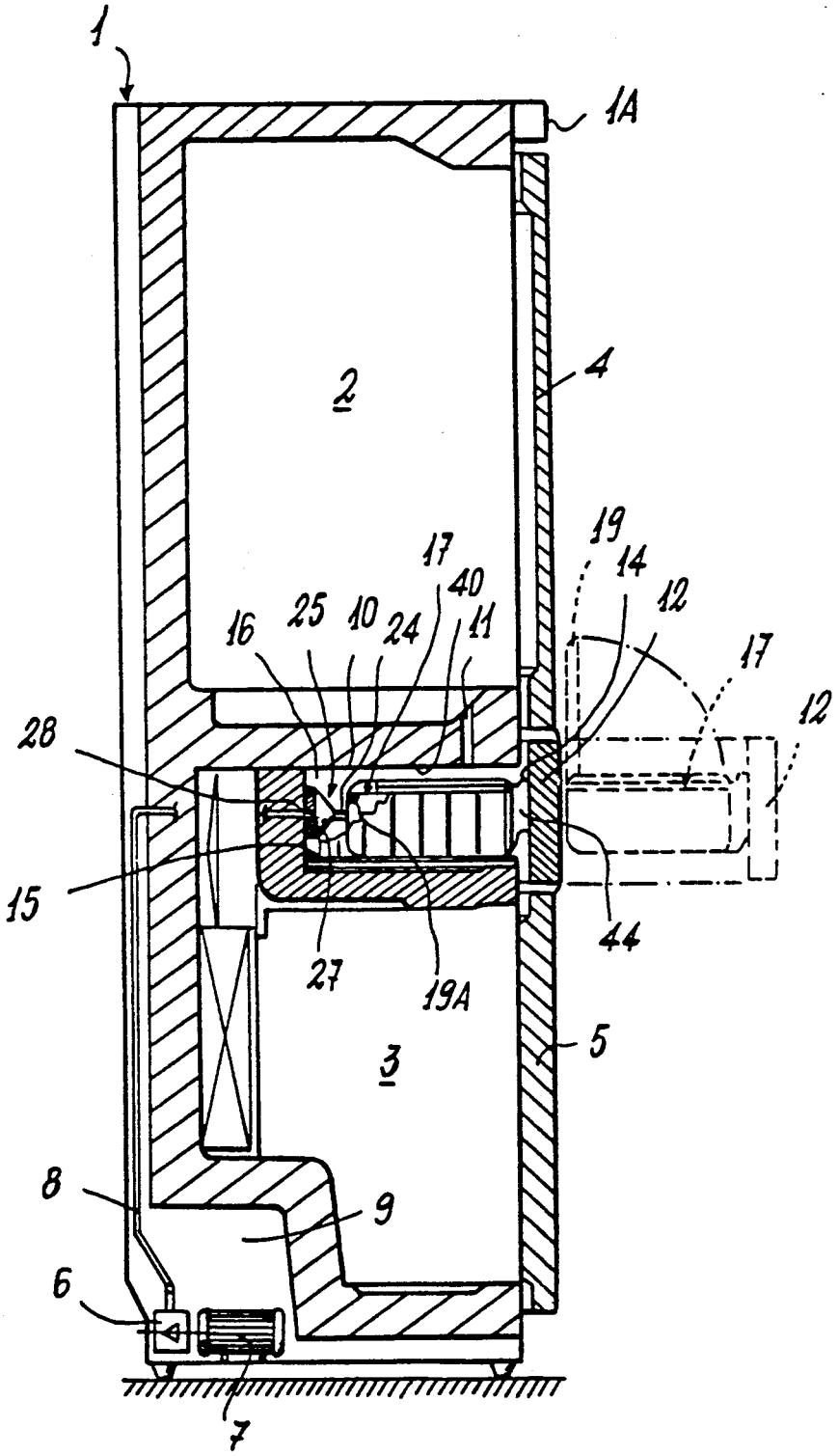
FIG. 1 is a vertical sectional view of a domestic refrigerator in accordance with the invention.

With reference to said figures a refrigerator or freezer comprises a cabinet 1 containing normal refrigeration and freezer compartments 2 and 3 provided with their own closure doors 4 and 5. The refrigerator is also provided with a vacuum pump 6 operated by an electric motor 7 from which an evacuation pipe 8 extends and terminates in a further refrigeration compartment 10 positioned between the refrigeration compartment 2 and freezer compartment 3. The pump is located in a chamber 9 provided below the freezer compartment 3.

The compartment 10 is maintained in known manner at a temperature substantially equal to 0° C. and is connected to the refrigeration compartment 2 by a duct 11.

Figure 2:
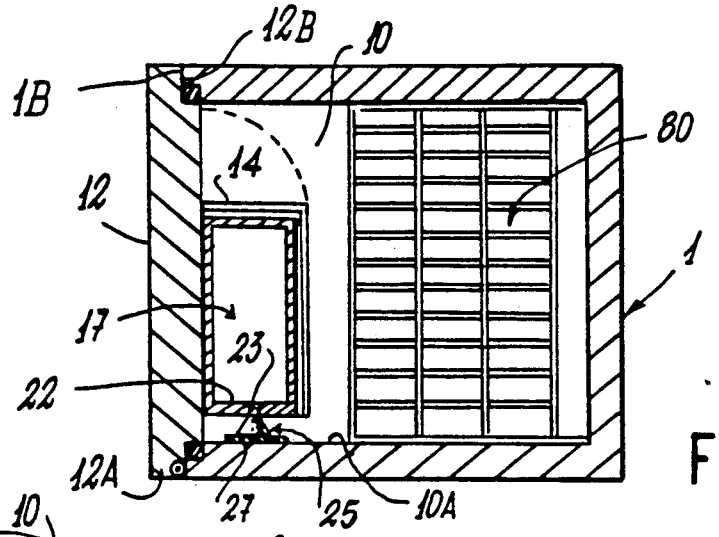
FIG. 2 is a cross-sectional view of a different embodiment of a refrigerator according to the invention.
Figure 3:
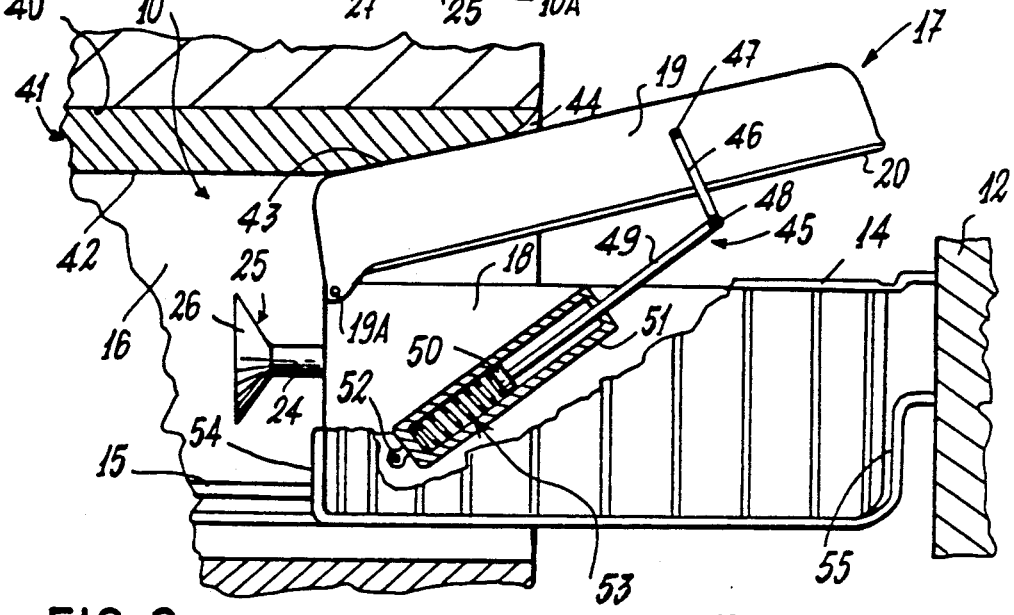
FIG. 3 is an enlarged view of a part of the refrigerator of FIG. 1 in which the container is partly drawn out.

Said compartment 10 is provided with its own door 12, which in FIGS. 1 and 3 is connected to a support or basket 14 slidable on guides 15 associated with walls 16 of the compartment. As an alternative to this "drawer-type" embodiment, the door can be hinged on its side a to the refrigerator cabinet 1 (see FIG. 2). A container 17 in which vacuum is to be produced is removably placed in the basket 14.

More specifically, said container contains (see FIGS. 1 and 4) a lower box part 18 which can be closed in a sealed manner by cover 19. To form the desired seal, the cover 19, which is hinged at one end 19A to the box part 18, comprises gaskets 20 which cooperate with the free ends of the walls of the box part 18. To evacuate the inner space of the container 17 there are provided means which comprise a pipe 23 in the rear wall 22 of the box part 18, and a hollow elastic element like a sucker 25. The sucker has a duct 24 which opens into a free end 26. The duct 24 is connected to one end of the pipe 23 projecting outside the container. The end 26 is arranged to cooperate with a flange 27 having an aperture 28 into which the pipe 8 connected to the, vacuum, pump 6 opens. Said flange is associated, preferably removably with the rear wall 30 of the compartment 10 and is secured to said wall in any known manner.

A usual filter element can be associated with the flange 27 and can be cleaned by removing said flange from said wall 30.

It will now be assumed that the door or drawer 12 is closed and the container 17 located in the compartment 10 is inserted into it such that the end 26 of the sucker 25 is in contact with the flange 27.

If the vacuum pump 6 is now operated (for example by a usual pushbotton located on the front 1A of the refrigerator cabinet 1), the suction produced by the pump acts through the pipe 8 on the sucker 25, to pull the sucker (and hence the container 17). Following this, as said container is located in the basket 14 which is associated with the door 12, said door also closes against the refrigerator cabinet.

The suction action of the pump 6 attracts the sucker 25 towards the flange 27 and its end 26 becomes sealed against it. At the same time, air is drawn through the sucker 25 and through the pipe 23 from the container 17, thus producing a vacuum in the container. After a certain time enough air is sucked out and the pump stops automatically or is stopped by hand.

If access is now required to the container 17, the door 12 is pulled to open it. As a result of the opening of the door the sucker 25 separates from the flange 27 and air can flow into said container to provide easy access to its interior. FIG. 1 shows by dashed lines the position in which the container 17 is used.

It should be noted that the door or drawer 12 can be opened with minimum force, and the vacuum in the container 17 is released without operating any valve, and merely by opening the drawer. FIG. 3 shows an embodiment of the compartment 10 and removable container 17 which allows automatic opening and closure of this latter as a result of the opening and closure of the door 12. In this figure, parts corresponding to those of FIGS. 1 and 4 are indicated by the same reference numerals.

Specifically, in the top wall 40 of the compartment 10 there is disposed a guide element 41 having a flat surface 42 which cooperates with the cover 19 of the container 17 when the door 12 is closed, and a curved end 43 close to the aperture of the compartment. The cover 19 slides along the curved end 43 when the door 12 is opened, the cover being raised from the box part 18 by thrust means 45 associated with the container 17.

In the example shown in FIG. 3 the thrust means 45 comprise a first arm 46 hinged at one end 47 to the cover 19 and at its other end 48 to a second arm 49 having a widened end 50. The end 50 is arranged to slide in a hollow cylindrical body 51 hinged at 52 externally to the box part 18 of the container 17. A compression spring 53 arranged inside the cylindrical body 51 acts on the widened end 50. The container 17 is retained in the basket 14 by the basket walls 54 and 55.

Figure 4:
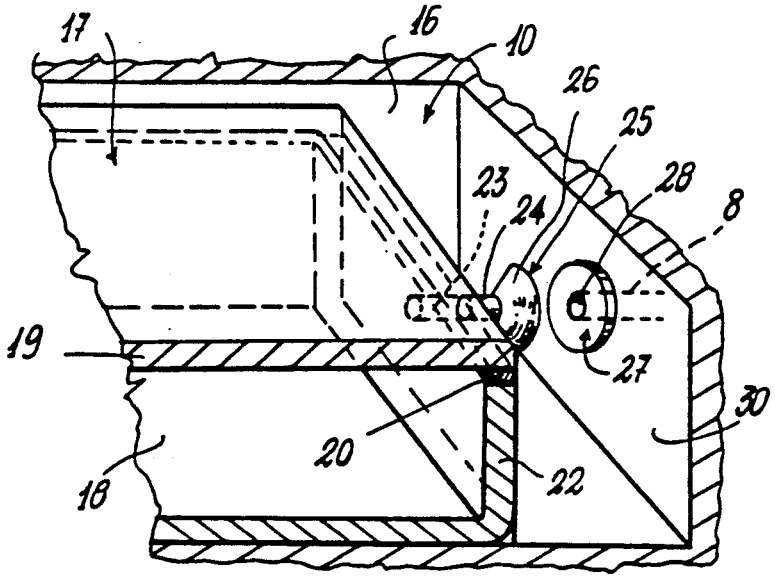
FIG. 4 is an enlarged partially perspective and sectional view of the refrigerator of FIG. 1 showing the connecting means.

The manner in which vacuum is created or released in the container 17 is identical to that described in relation to the use of the refrigerator shown in FIGS. 1 and 4.

However, in the embodiment of FIG. 3, the container 17 is opened and closed automatically by the opening of the door 12, as stated. In this respect, on opening said door the sucker 25 separates from the flange 27 situated on the rear of the compartment 10, and as the container is extracted from this compartment the thrust means 45 separate the cover 19 from the box part 18.

In particular, during the extraction of the support or drawer 14, the cover 19 slides along the surface 42 of the guide element 41 and when it reaches the end 43 it begins to rise by rotating about its hinged end 19A. This is attained by virtue of the thrust of the spring 53 against the end 50 of the arm 49, the end 50 sliding in the element 51. As a result of this the arm 49 rotates the arm 46, so urging it upwards in FIG. 3 with the consequent raising of the cover 19 of the container 17. It should be noted that during the extraction of the container from the compartment 10 and, the raising of the cover, the element 51 rotates about the hinge 52. In contrast, on closing the door 12 the cover 19 slides along the surface 43 to consequently move downwards in FIG. 3. As a result of this the arm 46 rotates the element 51 about the hinge 52 and causes the end 50 of the arm 49 to retract into said element 51 against the spring 53.

FIG. 2 shows another embodiment of a refrigerator with a removable container in which vacuum is produced. In this figure parts corresponding to those of FIGS. 1, 3 and 4 are indicated by the same reference numerals.

More particularly, in the FIG. 2 embodiment the container 17 is located in a basket associated with a door 12 which is hinged on one side 12A to the refrigerator cabinet 1, the flange 27 being located on a side wall 10A of the compartment 10.

Again in this embodiment the opening of the door releases the vacuum and its closure returns the sucker 25 into contact with the flange 27. If the pump 6 is now operated vacuum is produced in the container 17.

Alternatively a sucker similar to the sucker 25 can be provided on the free side 12B of the door, and a flange similar to the flange 27 can be provided on the side 1B of the cabinet 1 opposite said side 12B and incorporate a branch from said pipe 8. In this manner the operation of the pump 6 results not only in the creation of vacuum in the container 17 but also in secure closure of the door 12.

It should be noted that a normal food support grid 80 can also be provided in the compartment 10 to enable the compartment 10, kept substantially permanently at 0° C., to be used for preserving meat and fish.

A container 17 has been described disposed in a support 14 associated with the door 12 of the compartment 10. However a container can be provided which is freely insertable into said compartment and which is provided with normal handles for its handling, said container sliding on the lower wall of the compartment, which is provided with its own closure door.

In addition, as an alternative to the described examples, the sucker 25 (which can also be replaced by an element of bellows form) can be associated with the wall 30 of the compartment 10, whereas the flange 27 can be located on the rear wall 22 of the container 17 in front of said wall 30.

Finally, the guide element 41 can be replaced by one or more elastically loaded arms acting on the cover 19 of the container 17 so as to keep it closed against the box part 18 when the container has been inserted into the compartment 10 and to guide its closure against said part 18 during the re-insertion of the container 17 into the compartment 10 after its extraction.

A refrigerator constructed in accordance with the invention has the advantage that the vacuum is provided in a container which is removable (and therefore easily cleaned) and to which there is easy access. In addition there are no valves provided either for maintaining the vacuum or for releasing it, thus reducing the refrigerator manufacturing cost.

I claim:

1. A refrigerating apparatus comprising a cabinet (1) with a refrigeration compartment (10) closable by a door (12), which compartment is connected to an evacuating system comprising a vacuum pump (6) arranged in the cabinet and an evacuation pipe (8) between the vacuum pump and said compartment, wherein the apparatus comprises a container (17) closable in a vacuum-tight manner and movable within said compartment (10), and means for connecting and disconnecting the inner space of the container (17) with the pipe (8) of the evacuating system in response to opening and closing, respectively, of the door (12).

2. A refrigerator apparatus as claimed in claim 1, wherein the means comprise a container pipe (23) provided in a wall (24) of the container (17) through which the inner space of the container can be evacuated, and a hollow elastic element (25) connected to one of the ends of the pipes (8,23) to form a detachable seal against the other end.

3. A refrigerating apparatus as claimed in claim 2, wherein the elastic element (25) is a sucker or a bellows.

4. A refrigerating apparatus as claimed in claim 3, wherein the hollow elastic element (25) is disposed on an open end of the container pipe (23) at the outside of a wall (22) of the container (17) and faces an inside wall (30) of the compartment (10) around an open end of the vacuum pipe (8).

5. A refrigerating apparatus as claimed in claim 3, wherein the hollow elastic element (25) is disposed on an open end of the vacuum pipe at a wall (30) of the compartment (10) and faces an outside wall (22) of the container (17) around an open end of the container pipe (23).

6. A refrigerating apparatus as claimed in claim 2, wherein the hollow elastic element (25) comprises an end (26) which cooperates with a flange (27) disposed on one of the pipe ends connected to the container wall (22) or the compartment wall (30).

7. A refrigerating apparatus as claimed in claim 1, wherein the container (17) is associated with the door (12) of the refrigerator compartment (10) and is removably inserted into a support (14) associated with the door (12), said door (12) being hinged on one of its sides (12A) to the refrigerator cabinet (1) or being formed in the manner of a drawer.

8. A refrigerating apparatus as claimed in claim 1 in which the temperature of compartment 10 is maintained at a temperature substantially equal to 0° C.

9. A refrigerating apparatus comprising a cabinet (1) with a refrigeration compartment (10) closable by a door (12), which compartment is connected to an evacuating system comprising a vacuum pump (6) arranged in the cabinet and an evacuation pipe (8) between the vacuum pump and said compartment wherein the apparatus comprises a container (17) closable in a vacuum-tight manner and movable within said compartment (10) and means for detachably connecting the inner space of the container (17) with the pipe (8) of the evacuating system, said means comprising a container pipe (23) provided in a wall (24) of the container (17) through which the inner space of the container can be evacuated, and a hollow elastic element (25) connected to one of the ends of the pipes (8, 23), the hollow elastic element (25) comprising an end (26) which cooperates with a flange (27) disposed on one of the pipe ends connected to the container wall (22) or the compartment wall (30), said flange (27) being removable and comprising a filter member.

10. A refrigerating apparatus as claimed in claim 9 wherein the temperature of compartment 10 is maintained at a temperature substantially equal to 0° C.

11. A refrigerating apparatus comprising a cabinet (1) with a refrigeration compartment (10) closable by a door (12), which compartment is connected to an evacuating system comprising a vacuum pump (6) arranged in the cabinet and an evacuation pipe (8) between the vacuum pump and said compartment wherein the apparatus comprises a container (17) closable in a vacuum-tight manner and movable within said compartment (10) and means for detachably connecting the inner space of the container (17) with the pipe (8) of the evacuating system, said container (17) comprising elastically loaded means (45) arranged to cause automatic opening of a cover (19) of said container as the container is extracted from the compartment (10), said compartment comprising guide means (41) for guiding the cover (19) during opening and closing thereof.

12. A refrigerating apparatus as claimed in claim 11, wherein the elastically loaded means (45) comprise a first arm hinged (15 47) to the cover (19) and hinged (at 48) to a second arm (49), said second arm being subjected to the action of a compression spring (53) inserted into a substantially cylindrical body (51) hinged (at 52) to a side wall (18) of the container (17).

13. A refrigerating apparatus as claimed in claim 12, wherein the guide means are formed by an element (41) associated with a top wall (40) of the refrigerator compartment (10) and having a flat surface (42) arranged to cooperate with the cover (19) of the container (17) when this latter is inserted into said compartment, and a curved surface (43) in proximity to the aperture (44) of said compartment (10).

14. A refrigerating apparatus as claimed in claim 12, wherein the guide means (41) are elastically loaded elements acting on the cover (19) of the container (17).

15. A refrigerating apparatus as claimed in claim 11 wherein the temperature of compartment 10 is maintained at a temperature substantially equal to 0° C.

16. A refrigerating apparatus comprising a cabinet (1) with a refrigeration compartment (10) closable by a door (12), which compartment is connected to an evacuating system comprising a vacuum pump (6) arranged in the cabinet and an evacuation pipe (8) between the vacuum pump and said compartment, wherein the apparatus comprises a removable container (17) closable in a vacuum-tight manner and movable within said compartment (10), and means for connecting and disconnecting the inner space of the container (17) with the pipe (8) of the evacuating system in response to movement of the container (17) from a closed to an opened position, respectively.

17. A refrigerating apparatus as claimed in claim 16 wherein the temperature of compartment 10 is maintained at a temperature substantially equal to 0° C.

18. A refrigerating apparatus comprising a cabinet (1) with a refrigeration compartment (10) closable by a door (12), which compartment is connected to an evacuating system comprising a vacuum pump (6) arranged in the cabinet and an evacuation pipe (8) between the vacuum pump and said compartment, wherein the apparatus comprises a removable container (17) closable in a vacuum-tight manner and movable within said compartment (10), and means for connecting and disconnecting the inner space of the container (17) with the pipe (8) of the evacuating system in response to opening and closing, respectively, of the door (12) upon removal and reinsertion of the container (17) in the compartment (10).

19. A refrigerating apparatus as claimed in claim 18 wherein the temperature of compartment 10 is maintained at a temperature substantially equal to 0° C.

* * * * *